US007306220B2

(12) United States Patent
Farmer et al.

(10) Patent No.: US 7,306,220 B2
(45) **Date of Patent: *Dec. 11, 2007**

(54) MOVABLE SHEET GUIDE

(75) Inventors: Geoffrey A. Farmer, Ingatestone (GB); Paul Blamire, Bishop's Stortford (GB); Eric A. Belec, Southbury, CT (US); Peter Watson, Rayleigh (GB); Keith G. R. Watts, Abbots Langley (GB); Chris Brown, Baldock (GB)

(73) Assignee: Pitney Bowes Ltd., Harlow Essex (GB)

( * ) Notice: Subject to any disclaimer, the term of this patent is extended or adjusted under 35 U.S.C. 154(b) by 370 days.

This patent is subject to a terminal disclaimer.

(21) Appl. No.: 11/034,117

(22) Filed: Jan. 12, 2005

(65) Prior Publication Data

US 2006/0151932 A1 Jul. 13, 2006

(51) Int. Cl.
*B65H 9/04* (2006.01)

(52) U.S. Cl. ..... 271/245; 271/213; 271/215; 270/59

(58) Field of Classification Search ..... 271/245, 271/213, 215, 3.03; 270/59, 58.11, 58.12, 270/58.17, 58.07
See application file for complete search history.

(56) References Cited

U.S. PATENT DOCUMENTS 1,763,735 A * 6/1930 Wydom ..... 226/53
4,353,541 A * 10/1982 Parzygnat ..... 271/275
4,511,131 A * 4/1985 Raybuck ..... 270/52.17
4,605,211 A * 8/1986 Sonobe ..... 270/58.17
4,666,144 A * 5/1987 Silverberg ..... 271/270
4,767,115 A * 8/1988 Garthe ..... 271/223
5,147,092 A * 9/1992 Driscoll et al. ..... 271/184
5,320,336 A * 6/1994 Asami ..... 270/58.08
5,507,481 A * 4/1996 Meyer et al. ..... 271/240
5,566,933 A * 10/1996 Salancy ..... 271/273
5,692,745 A * 12/1997 Neifert et al. ..... 271/198
5,915,686 A * 6/1999 Neifert et al. ..... 271/198
6,010,124 A * 1/2000 Higashikawa et al. ..... 271/3.02
6,142,469 A * 11/2000 Nanba et al. ..... 271/288
6,168,154 B1 * 1/2001 Asahara et al. ..... 271/245
6,199,850 B1 * 3/2001 Seki ..... 270/58.07
6,209,864 B1 * 4/2001 Taniguchi et al. ..... 271/220
6,575,448 B1 * 6/2003 Tokutsu ..... 271/9.01
6,644,651 B2 * 11/2003 Allsup ..... 271/184
6,802,502 B2 * 10/2004 Hasegawa et al. ..... 270/58.12
6,902,162 B2 * 6/2005 Otto et al. ..... 271/207
7,120,384 B2 * 10/2006 Kenji et al. ..... 399/408

(Continued)

*Primary Examiner*—Patrick Mackey
*Assistant Examiner*—Gerald W McClain
(74) *Attorney, Agent, or Firm*—Ronald Reichman; Angelo N. Chaclas

(57) ABSTRACT

An accumulator apparatus for paper collations having an accumulation chamber for receiving sheet material, the chamber defined by a fixed guide on one side, a movable guide on the other side and a movable stop member at one end. Rollers are included for driving the sheet material against the stop member, and gates are provided for moving the movable guide between a first position in which it is spaced from the fixed guide by a gap sufficiently small to prevent buckling of the sheet material as it is driven by the rollers against the stop member, and a second position in which the movable guide is spaced away from the fixed guide for discharge of the sheet material from the chamber.

23 Claims, 9 Drawing Sheets

U.S. PATENT DOCUMENTS

| | | | | |
|---|---|---|---|---|
| 7,175,174 | B2 * | 2/2007 | Terao et al. | 270/58.12 |
| 7,178,799 | B2 * | 2/2007 | Wakabayashi et al. | 270/39.06 |
| 2002/0043754 | A1 * | 4/2002 | Coombs et al. | 270/58.07 |
| 2002/0047233 | A1 * | 4/2002 | Coombs et al. | 270/58.07 |
| 2003/0067106 | A1 * | 4/2003 | Mizuta et al. | 270/58.07 |
| 2005/0179190 | A1 * | 8/2005 | Kamiya et al. | 270/58.07 |

* cited by examiner

MOVABLE SHEET GUIDE

FIELD OF THE INVENTION

This invention relates to a guiding apparatus for use in an accumulator of a sheet handling apparatus and is applicable to an apparatus and method for processing of elongate elements or articles, and in particular to an apparatus and method for selectively performing a plurality of operations on each of a number of different sheet or booklet elements, as well as envelopes.

BACKGROUND OF THE INVENTION

It is well known to provide a machine for successively performing several operations on various sheet elements. For example, operations on an envelope might include flapping, inserting, moistening and sealing, whilst operations on one or more sheets might include collating, folding and inserting into an envelope. It is further known to provide a machine which collates several sheets of paper into a bundle, folds the bundle, places an insert, such as a leaflet or booklet into the bundle, provides an envelope which is held open, inserts the folded sheets into the envelope, moistens the envelope and seals it, before ejecting the envelope into a receiving tray or bin. Each of these operations is distinct and requires a separate and unique processing region within the machine in order to successfully and repeatably carry out the required operation on the respective element. As a result, folder/inserter machines of the type described hereinbefore are typically large and complicated to program.

Recently, there have been moves towards reducing the size of such folder inserter machines in order to make them more accessible to smaller businesses, such as SOHO (small office/home office) operations. In order to be successful in this environment, the folder/inserter must occupy a small footprint (i.e. the area of floor/desk-surface occupied), perform reliably, and be easy to control without requiring specialist training.

GB-A-2380157 discloses a small office folder/inserter having two trays, one for storing sheets to be folded and the other for storing inserts to be inserted into the sheets. One location is specified for folding said sheets, another location for placing the insert into the folded sheets, and a further location for inserting the folded bundle into an envelope. The machine further comprises a location for storing envelopes, means for opening said envelopes and holding the envelopes open to receive the folded bundle at the inserting location, a section for moistening the flap of the envelope and a section for closing the flap of the envelope to seal it and ejecting the envelope to a receiving tray. Because of the small size and compactness of the machine, it is suitable for performing only a limited number of cycles in a given time period, i.e. it does not have a very high-volume throughput. Further, such machines can lack versatility, since they are suitable only for performing the respective feeding, folding, inserting, envelope opening, envelope moistening and sealing operations on a limited range of sizes of sheets/inserts.

Large organisations, such as banks, telephone companies, supermarket chains and the government, for example, are often required to produce extremely large throughputs of specifically-addressed mail to a regional or national audience. Machines capable of producing the high volumes required, whilst simultaneously accurately ensuring that the correct content is sent to the correct individual recipients, are typically very large, often occupying an entire warehouse.

By contrast, existing small office equipment is typically capable of producing mailshots for a few hundred to one or two thousand addressees.

Demand, therefore, exists for a machine of intermediate production capacity, typically for small to regional businesses, which does not occupy a vast quantity of the available office space. Particularly in large cities, office space is charged at premium rates for each square metre. As such, the cost of running and maintaining a folder/inserter will also comprise the cost of renting the office space which it occupies.

For folder/inserter apparatuses intended for small and medium sized businesses, it is at least desirable, if not necessary, for the machine to be able to accommodate a range of different materials. For example, it will be necessary to accommodate different thicknesses of sheet element, as well as different sizes and numbers thereof. Similarly, any materials to be inserted within a folded package might range from a compliment slip to an entire booklet, including inserts of unconventional size or shape. It is also advantageous for such machines to be able to accommodate different sizes of envelopes, such as A4 and A5, depending on the material to be inserted thereinto.

One operation often carried out in such folder/inserter apparatuses is the accumulation of a plurality of individual sheets into an ordered bundle. This can typically be achieved by driving each sheet against a hard stop or other halting means, such as pinch rollers. When driving, for example, a piece of paper up to and against a hard stop or gate, in a system for accumulating several sheets of paper, the maximum drive force that can be applied is limited by the column strength of the paper before it buckles and becomes damaged. This can have an adverse effect on operation and may cause increased costs to achieve very tight tolerances on the drive force. Compressing the paper against a flat plate can increase the column strength by preventing the buckle from forming. However, a high normal force introduces a high resultant force from the friction, particularly between multiple sheets, which can then negate the increased drive force. Using a lower normal force on the plate reduces this extra friction (although doesn't remove it) but can enable the paper to push the plate away. Additionally it is often necessary to cope with a wide range of paper thicknesses and sometimes to allow exceptional document packs to pass through, such as those with staples. These can become trapped under the plate.

SUMMARY OF THE INVENTION

According to one aspect of the present invention, there is provided an accumulator apparatus for paper collations comprising: an accumulation chamber for receiving sheet material, the chamber defined by a fixed guide on one side, a movable guide on the other side and a movable stop member at one end; driving means for driving said sheet material against said stop member; and means for moving the movable guide between a first position in which it is spaced from the fixed guide by a gap sufficiently small to prevent buckling of the sheet material as it is driven by the driving means against the stop member, and a second position in which the movable guide is spaced away from the fixed guide for discharge of the sheet material from the chamber.

According to a second aspect of the invention, there is provided a guiding method comprising: driving sheet material into an accumulation chamber against a movable stop along a sheet feed path in a sheet feed direction between a fixed guide defining one side of said chamber and a movable guide defining the other side of said chamber; and selectively moving the movable guide between a first position in which it is in close proximity to the fixed guide, to prevent buckling of sheet material as it is driven against the stop and a second position in which the movable guide is spaced from the fixed guide for discharge of the sheet material from the chamber.

BRIEF DESCRIPTION OF THE DRAWINGS

For a better understanding of the invention and to show how the same may be carried into effect, reference will now be made, by way of example, to the accompanying drawings, in which.

DETAILED DESCRIPTION OF THE INVENTION

Throughout the drawings, like numerals are used to identify like components.

Figure 1:
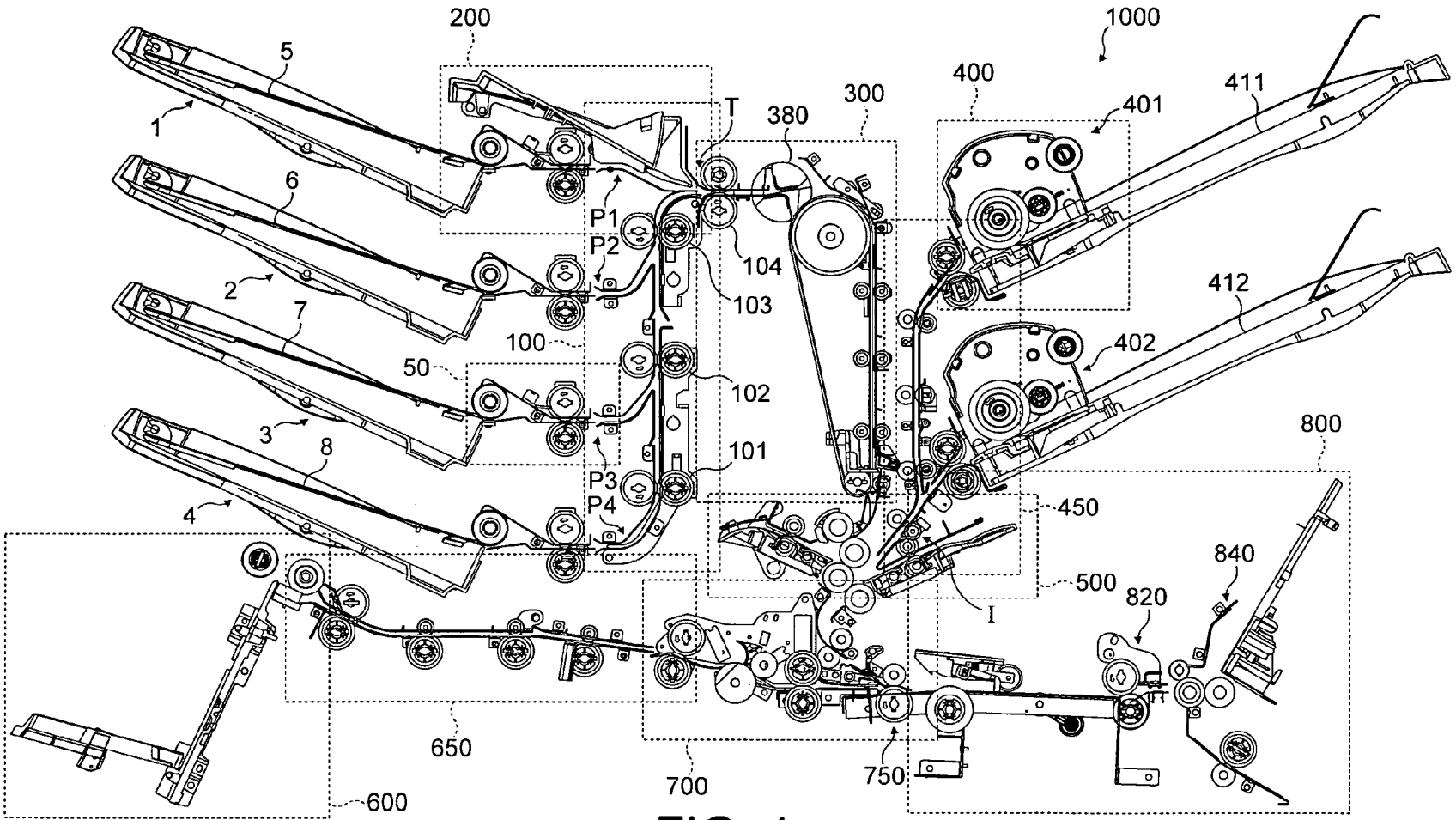
FIG. 1 is a cross-sectional view of a sheet handling apparatus detailing the different machine sections and components.

FIG. 1 shows a folder/inserter apparatus 1000 embodying the present invention. This embodiment is exemplary only, and is used to highlight and explain the inventive concept defined by the appended claims.

FIG. 1 shows a cross-sectional view of the folder/inserter apparatus 1000 and schematically shows various sections of the machine. The folder/inserter apparatus 1000 comprises a sheet feeder section including sheet feeders 1, 2, 3 and 4, from which sheets are fed into a collation section 100 where they are collated into an ordered paper stream. The paper stream is then fed along a sheet feed path which merges with an inlet from a convenience feeder 200, which acts as an alternative sheet feeder for certain documents. The sheets then pass through an accumulator section 300 where they are grouped together as an ordered and aligned package. From the accumulator, the sheets pass through a sheet folder 500. Inserts fed from insert feeders 401 and 402 are collated in an insert feeder collation section 450 and then fed into a folded collation. An envelope is fed from an envelope feeder 600 along an envelope transport path 650 to a flapper 700 where the envelope flap is opened and the mouth of the envelope held open at insertion section 750 to receive the folded collation. The collation is inserted into the envelope and the envelope is fed into a final section 800 where the gum on the envelope flap is moistened and the envelope sealed. The sealed envelope is then ejected into a receiving tray or bin.

Referring now to FIG. 1 in more detail, there is shown an inlet section which includes four sheet feeders 1, 2, 3 and 4. Each of these sheet feeders comprises a respective sheet feeder tray 5,6,7 or 8 into which a stack of sheets may be placed. The sheets in each tray are fed individually into a sheet feed path by respective sheet deskew mechanisms 50 which each act to separate a single sheet from the top of a stack of sheets in the associated sheet feeder tray and to feed the separated sheet into and along the sheet feed path. Four deskew mechanisms 50 are shown in FIG. 1, only one of which is identified by reference numeral 50 in FIG. 1. The other three deskew mechanisms are either identical or equivalent to that labelled 50. Each of the sheet feeder deskew mechanisms feeds into a common sheet feed path via respective sheet feeding inlet paths P1,P2,P3 and P4. The convenience feeder 200 similarly feeds into the common sheet feed path. All inlets to the sheet feed path from the four sheet feeders and from the convenience feeder 200 merge by a point T within the sheet feeder collation section 100. From the point T, the sheet feed path continues as a single sheet feed path up to the folder station 500. The sheet feed path passes first through the accumulator 300, where a plurality of sheets may be brought together to form an aligned and ordered package. The sheet feed path then passes through the sheet folding section 500 which produces a desired fold pattern in the accumulated document. As shown on the righthand side of FIG. 1, a pair of insert feeders 401, 402 are provided. Each insert feeder 401, 402 has a respective feeder tray 411, 412 which holds a plurality of inserts to be inserted into the folded collation. Each insert feeder further has an associated feeder device 400 for feeding a single insert into the insert collation section 450. Inserts fed into the insert collation section 450 are collated together and then inserted into the main folded collation. On the lefthand side of FIG. 1 below the sheet feeders 1,2,3 and 4 is located the envelope feeder 600. Envelope feeder 600 holds a plurality of envelopes which are fed along the envelope transport path 650 and into the flapper mechanism 700. The flapper mechanism 700 opens the flap of each envelope and uses mechanical fingers to hold the mouth of the envelope apart at insertion section 750 in order to allow the folded sheets (and any inserts) to be projected into the envelope. The envelope, with inserted documents, then continues along the sheet feed path to the final section 800 in which the gum on the envelope flap is moistened and the flap is sealed. The sealed envelope is then ejected from the folder/inserter apparatus 1000.

The operation of the folder/inserter apparatus is now considered in more detail with reference to FIGS. 2 to 6.

Figure 2:
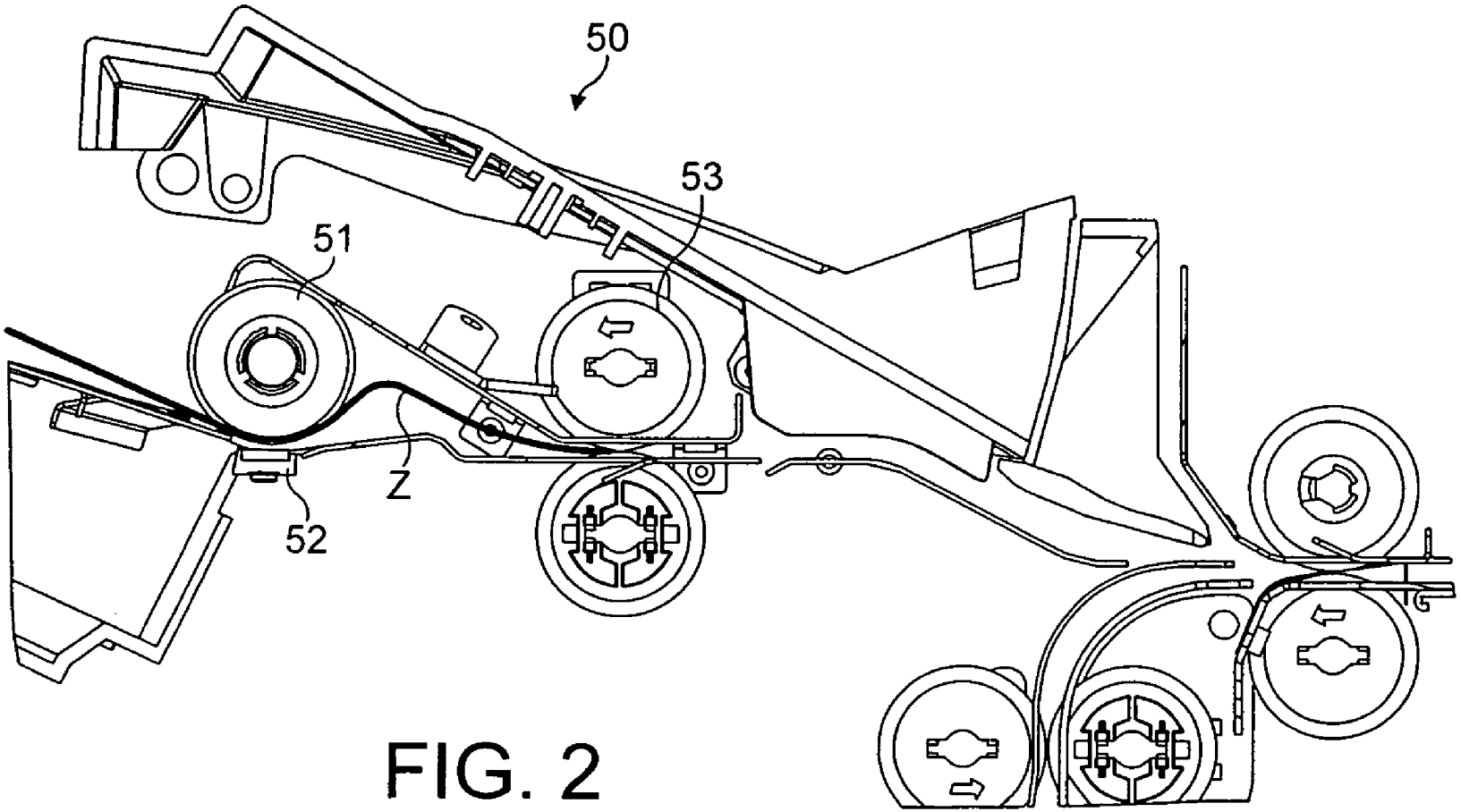
FIG. 2 is a cross-sectional view of a sheet feeder deskew mechanism.

Referring now to FIG. 2, the sheet feeder deskew mechanism 50 comprises a separator roller 51 which applies a driving force to the uppermost sheet in a stack in the sheet feeder tray. The separator roller 51 presses against a separator pad 52, normally in the form of a separator stone. This separator stone 52 prevents more than one sheet at a time from being fed into the sheet feed path by the roller 51. The single sheet removed from the sheet feeder tray by the separator roller 51 is then driven towards a deskew roller pair 53 which is maintained stationary. As the sheet engages the nip defined by the deskew roller pair 53 it is caused to buckle (as illustrated at Z). This forces the lead edge of the sheet to align with the nip of the deskew roller pair 53. The separator roller 51 is then stopped and the deskew roller pair 53 operated to drive the sheet along the sheet feed path and into the sheet feeder collation section 100.

Figure 3:
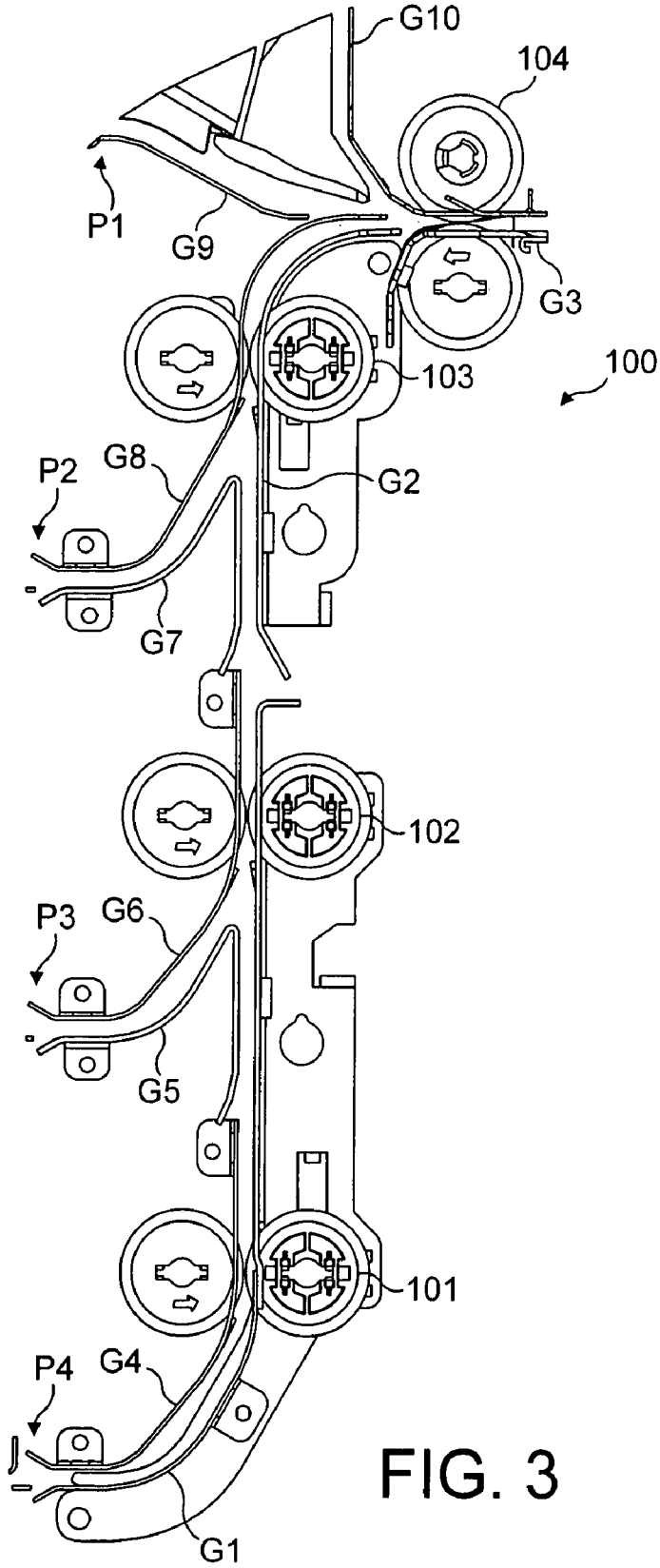
FIG. 3 is a cross-sectional view showing the sheet feeder collation section.

With reference to FIG. 3, each sheet fed from a sheet feeder 1,2,3 or 4 or convenience feeder is received in the respective sheet feeding inlet path P1,P2,P3, P4 or P5 defined by guides G1 and G4 to G10. The sheet feeding inlet paths merge into a single sheet feed path in the sheet feeder collation section 100. Sheet feeding roller pairs 101,102,103 and 104 are located along the sheet feed path for forcing the sheets along the sheet feed path.

In a typical sheet folding/inserting operation involving a four-page document, referring also to FIG. 1, the first sheet feeder tray 5 receives a stack of sheets corresponding to page 1 of the document, the second sheet feeder tray 6 receives a stack of sheets corresponding to page 2 of the document, the third sheet feeder tray 7 receives a stack of sheets corresponding to the page 3 of the document, whilst the fourth sheet feeder tray 8 receives a stack of sheets corresponding to page 4 of the document. A single sheet is then fed sequentially from each of the first to fourth sheet feeders. The first sheet from the first sheet feeder 1 passes into and along the sheet feeding inlet path P1 and partially along the common sheet feed path. A sheet is then fed from the second sheet feeder 2 such that the leading edge of the second sheet partially overlaps the trailing edge of the first fed sheet within the sheet feeder collation section 100. Similarly, the third sheet is fed so that the leading edge of the third sheet partially overlaps the trailing edge of the second sheet, whilst the fourth sheet is fed so that its leading edge partially overlaps the trailing edge of the third sheet. This forms a collation of the sheets along the sheet feed path in the sheet feeder collation section 100. The guides G1 to G10 defining the sheet feed path are configured and arranged to ensure that, as the sheets are sequentially fed into the sheet feed path and carried to overlap as described above, they become correctly collated in the intended order.

Because the requirement is that the adjacent sheets in the sheet collation only partially overlap at the leading and trailing edges, it is possible to drive the sheet collation along the sheet feed path at high speed without requiring a complex control system to ensure that each of the sheets is correctly aligned with those adjacent to it. This enables a high-volume throughput of mail packages to be achieved.

Figure 4:
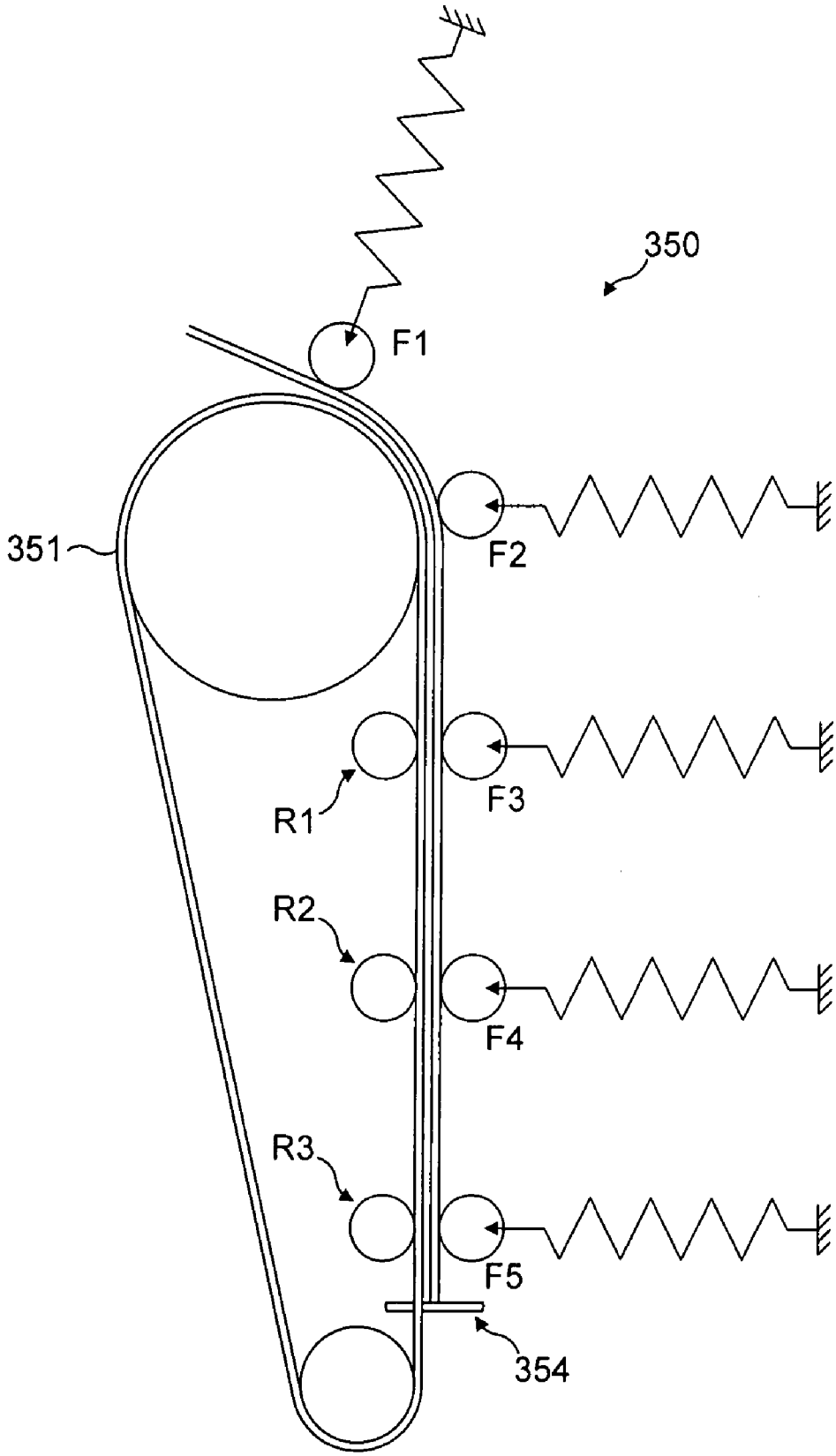
FIG. 4 is a schematic view of an accumulator according to an embodiment of the present invention.
Figure 5:
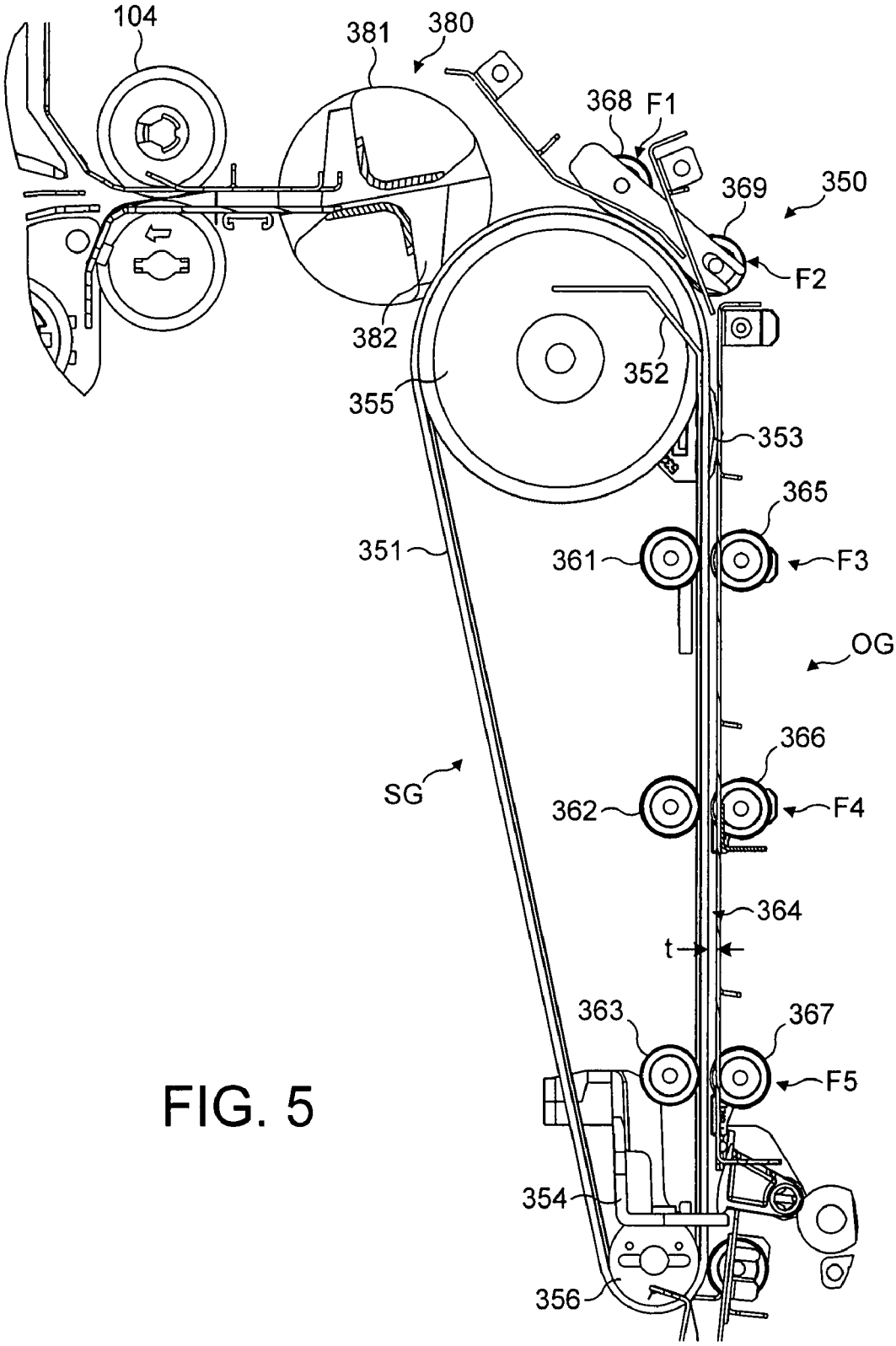
FIG. 5 is a cross-sectional view showing the accumulator installed in a sheet handling apparatus.
Figure 7:
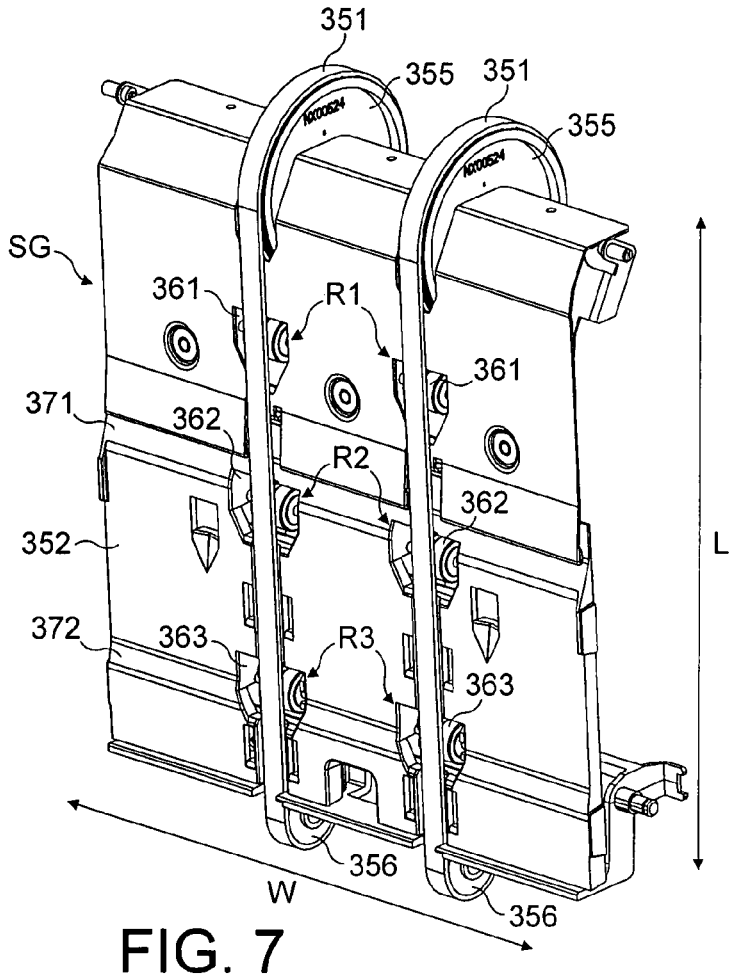
FIG. 7 is a perspective view of the movable guide and driving means.

Referring now to FIGS. 4 and 5, the sheet collation is then driven from the collation section 100 into an accumulation section 300 comprising a vertical accumulator 350. Here, as each sheet arrives in the accumulator 350, it is gripped and forcibly advanced through the accumulator by a pair of traction belts 351 running vertically and mutually parallel on a sled 352 (as best shown in FIG. 7). A plurality of spring-biased idler rollers 365 to 369 are provided for each traction belt 351 to apply forces F1 to F5 to maintain the most recently-arrived sheet in contact with the tractions belts 351. Each sheet fed into the accumulator 350 arrives at an accumulation chamber 364 defined on one side by a sled guide assembly SG including the sled 352 and the traction belts 351 and on the other side by a fixed guide assembly OG including fixed guide 353 and idler rollers 365 to 367. The accumulation chamber 364 is substantially straight and vertical, such that the collation is accumulated into a vertical stack of sheets. At the bottom of the accumulation chamber 364 is an accumulation gate 354 functioning as a stopping device. Each sheet entering the accumulator 350 is driven downwardly through the accumulation chamber 364 towards the accumulation gate 354 by the traction belts 351 until its leading edge comes into contact with the accumulation gate 354. This causes the sheet leading edge to impinge on the accumulation gate 354 and the sheet to become correctly aligned within the accumulation chamber 364. The sheet is then maintained within the accumulation chamber 364 and rests on the accumulation gate 354, whilst further driving of the traction belts causes slippage between the traction belts 351 and the sheet. Thus, once the first sheet has been stopped by the accumulation gate 354, the second and subsequent sheets are consecutively driven into alignment with the first sheet by the traction belts 351 driving each sheet in turn along the accumulation path and against the accumulation gate 354 to form an ordered collation. When all of the sheets in the collation have been successfully grouped at the accumulation gate 354, the accumulation gate opens to allow the collation to progress out from the accumulation chamber 364 along the continuation of the sheet feed path.

Figure 8:
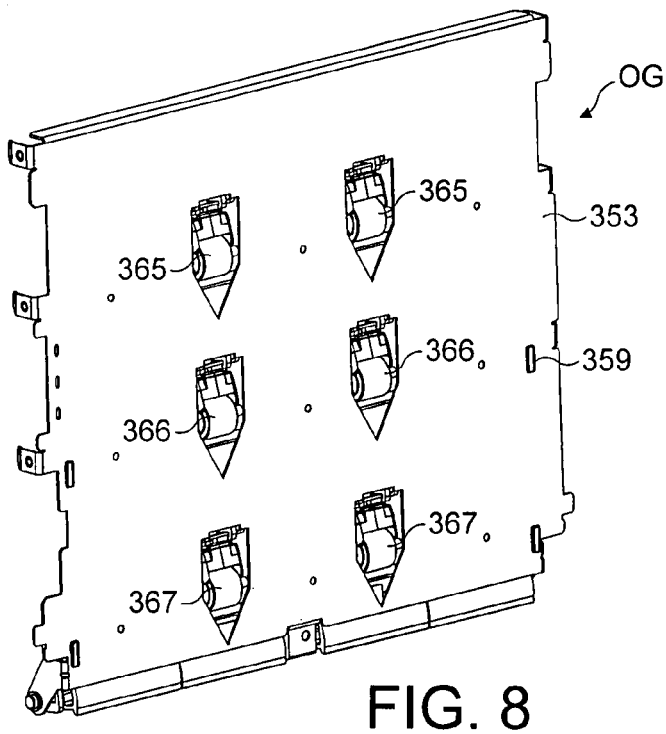
FIG. 8 is a perspective view of the fixed guide.

Referring now to FIG. 8, it can be seen that the accumulator comprises the fixed guide assembly OG, and movable sled guide assembly SG. The movable guide assembly SG includes driving means in the form of the pair of traction belts 351. The fixed guide assembly OG includes idler rollers 365 to 367 for pressing the sheets to be accumulated against the traction belt 351 and rollers 361 to 363 for pressing the traction belt against the sheets to be accumulated. The movable guide assembly also includes the sled 352 for assisting guidance of the sheets, or collations of sheets, into an accumulated bundle whilst accommodating a variable thickness of accumulation. These features define a section of sheet feed path which is substantially vertical and acts as the accumulation chamber 364. In the embodiment shown, the means for driving the sheets downwardly towards the accumulation gate 354 is the pair of traction belts 351, although any suitable system of belts and rollers could be used. The present embodiment has two drive belt assemblies which each consist of one of the traction belts 351, a drive roller 355 and a secondary tension roller 356 which holds the traction belt 351 under tension, along with idler rollers 361, 362, 363 in the sled 352 acting in opposition to the idler rollers 365 to 367 in the fixed guide assembly. The idler rollers 365 to 367 associated with the fixed guide 353 could alternatively take the form of miniature drive belts biased towards the fixed idler rollers 361, 362,363 in the sled, but preferably sprung idler rollers are biased towards the traction belts. Further, idler rollers 368 and 369 are mounted on a further guide component positioned above guide 353 (see FIG. 5). The idler rollers 365 to 369 may be arranged to apply a force to the sheet which varies along the length of the accumulation chamber 364 and around the drive rollers 355 of the traction belt mechanisms 351. Such a variable traction force over the length of the accumulation chamber, preferably ensuring a larger force towards the bottom of the accumulation chamber, reduces the column strength of a sheet required to enable it to resist the frictional driving forces of the traction belts. In the present embodiment, the varied force is achieved by using sprung idler rollers 365, 366 and 367, each of which is biased towards the traction belts 351 by a different spring force, the spring force being largest for roller 367 and least for roller 365. The downward driving force is resisted at the bottom of the accumulator by the accumulation gate 354, but it is important that the traction forces from the driving means do not cause the individual sheets to buckle or concertina.

In traditional accumulators, the accumulated collation must be mechanically forced in order to propel it further along the sheet feed path. Because contact can be achieved only with the front and rear sheets at any time, the acceleration given to the accumulated collation must be limited in order to ensure that adjacent sheets do not slide relative to one another, thereby spreading apart the accumulated collation. As a result of the vertical orientation of the accumulation path in the present embodiment, a downward acceleration of 1 g (i.e. under gravitational force) can be achieved without mechanical forcing. In addition, using additional forcing methods, a further acceleration of 1 g may be imparted to the collation without resulting in the separation of adjacent sheets. Hence, accumulated collations emerging from the accumulator 350 of the present embodiment may be accelerated at roughly 2 g without resulting in sliding separation of the sheets. This allows for faster progression of the accumulated collation through the folder/inserter 1000, resulting in a higher-volume throughput of sheet packages.

Referring again to FIGS. 4 and 5, the operation of the accumulation section 300 will be described in more detail.

As already outlined, as the sheet collation enters the accumulation section, the individual sheets are engaged by the pair of accumulator driving belts 351. At the accumulator inlet side, a pair of drive rollers 104 (FIG. 5) feeds the sheet material along the sheet feed path towards the drive belts 351. The drive belts 351 are stopped whilst the drive rollers 390 continue to feed a sheet into the accumulator 350. This allows subsequent sheets arriving after the first to be effectively overlapped with the sheet or sheets already in the accumulator 350 to ensure that they are engaged by driving means 351 and accumulated in the correct order.

According to the present embodiment, there are three methods by which a document may be fed into and accumulated in the accumulator. The first is as described above, where individual sheets are fed from the separate feed trays 1, 2, 3, 4 (FIG. 1), loosely collated in the sheet feeder collation section 100, and then accumulated in the accumulator 350. In this mode, the sheets pass directly into the accumulation chamber in the correct order because they are already partially overlapped. As such, the second and subsequent sheets are always received between the sheet(s) already present in the accumulator and the traction belts 351, so that they are driven downwardly and accumulated against the accumulation gate 354 in the correct order.

The folder/inserter may also operate in two further modes for folding a mail piece and inserting it into an envelope. According to the second method, pre-stapled sheets, for example a five-page document stapled in one corner, are placed in the convenience tray 200. This document is then fed directly to the accumulation chamber, where no further accumulation is required owing to the sheets being stapled. The document then exits the accumulation chamber and is folded and inserted as normal.

According to the third method of operation, a plurality of ordered, loose sheets are placed in convenience feeder 200 or one of the sheet feeder trays 5, 6, 7 or 8 (FIG. 1). These sheets are fed successively one-at-a-time along the sheet feed path and into the accumulator. However, in this mode, the sheets are not partially overlapped in the paper feed path, and this leads to the risk that the sheets will become incorrectly ordered, or incorrectly fed into the accumulator, leading to mis-collated mail packages or a jam in the folder/inserter machine 1000.

To overcome this problem, a trail edge deflector 380 is provided (FIGS. 1, 5). In the third mode, the trail edge deflector acts to lift the trail end of a sheet whose lead end is already in the accumulator 350, to thereby ensure that the subsequent sheet to arrive is fed into the accumulator between the previous sheet and the traction belts 351. The trail edge deflector 380 comprises a roller 381 through which there is a passage 382 suitable for allowing one or a plurality of sheets to pass through the roller. The passage is flared at the inlet and outlet thereof to better accept the introduction of a sheet leading edge, to prevent jamming of the folder/inserter 1000.

In the first and second modes the sheet(s) or stapled document(s), etc. simply pass through the passage in the deflector and into the accumulator.

In the third mode of operation, the sheets arriving individually pass part-way through the passage, and the leading edge of the sheet enters the accumulator 350 and is contacted by the traction belts 351 to drive it down against the accumulation gate 354. As the trail edge of each sheet reaches the trail edge deflector, the deflector rotates by 180° (anticlockwise as shown in FIG. 5). This forces the trail edge of that sheet upwards and it then lies above the trail edge deflector. The inlet and outlet of the passage 382 through the trail edge deflector have then reversed positions and the subsequent sheet enters the passage through what was previously the outlet. This is possible because the passage has a cross-section with rotational symmetry. The subsequent sheet is then guaranteed to be fed into the accumulator underneath the trail edge that was previously deflected, i.e. between the previous sheet and the traction belts.

This third mode of operation is particularly useful when, for example, a document has been printed by a laser jet printer and is collated in the correct order, and it is not desired to have to sort the individual pages of the document into the appropriate individual sheet feed trays.

After leaving the accumulator, the collation passes into the folding section 500 which contains a variable folding apparatus. The operation of such a folding apparatus is known, for example from GB-A-2380157. Brief explanation is given here for a more complete understanding.

Figure 6:
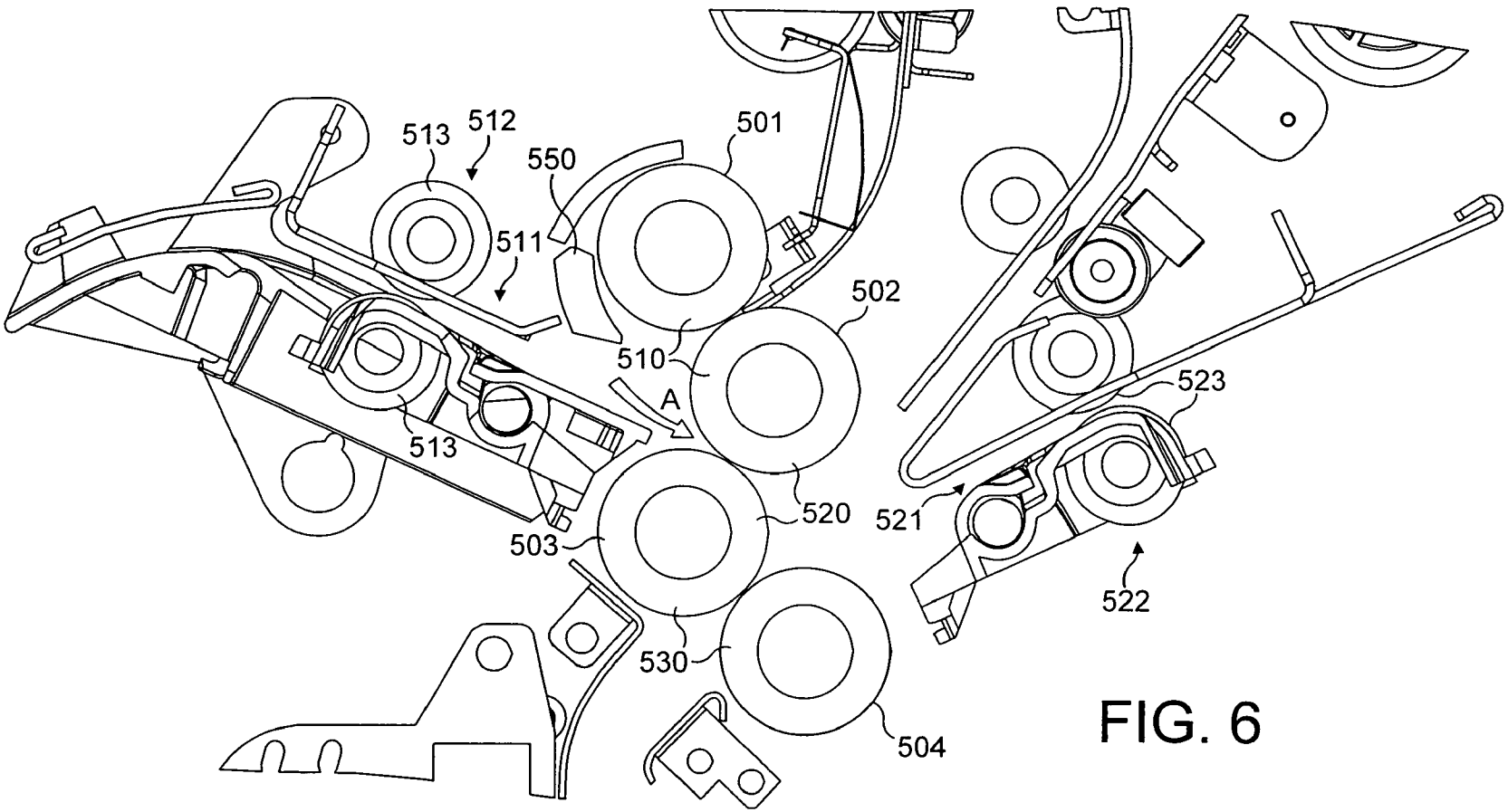
FIG. 6 is a cross-sectional view showing the sheet folding section.

Referring to FIG. 6, the folding apparatus comprises four rollers 501,502,503 and 504 arranged to form three pairs 510,520 and 530. The leading edge of the collation passes through the first roller pair 510 and into a buckle chute 511 until it reaches an adjustable stop 512, here constituted as a pinch roller pair 513 which selectively stops the collation based on detection of the leading edge position. At this point, the first roller pair continues to feed the sheet collation, causing it to buckle, and causing the buckled portion to enter the nip between the second roller pair 520. This results in the buckled portion being fed through the second roller pair 520 and forming a fold at the buckle, at a predetermined position. The folded edge then becomes the lead edge of the collation and it is fed through the second roller pair 520 into a second buckle chute 521 until it moves into contact with a second stop 522 (which is preferably a pinch roller pair 523) which halts its movement. The second roller pair 520 continues to feed the trailing edge of the sheet collation therethrough. Again, this causes the collation to buckle, and the second buckle is forced into the nip of the third roller pair 530, resulting in a second fold in the sheet collation at a predetermined point in the region of the second buckle.

By selectively determining the point at which the sheet collation is halted by the stops 512,522 at each stage, it is possible to always achieve the folds in the desired position. Further, by appropriately selecting the distance from the roller pairs at which the collation is halted, the same apparatus can selectively perform either a double fold, a "Z" fold or a "C" fold in the sheet collation. Equally, the sheet collation need only be folded a single time, for example simply folded in half. This single fold is achieved by operation of a half-fold mechanism 550. If a half-fold operation is selected, the half-fold mechanism 550 moves in the direction of arrow A to an interference position where it intercepts and redirects the accumulated collation as it exits the first roller pair 510. The collation is then directed immediately through the second roller pair 520, rather than into the first buckle chute 511. Accordingly, the first fold is never made in the collation at the nip of the second roller pair, and only a single fold is created as the collation is buckled in the second buckle chute 521 and the buckle passes through the third roller pair 530, as normal.

Referring again to FIG. 1, after the final fold is made, one or more inserts may be fed from insert feeders 401 and 402 shown on the right hand side of FIG. 1. The present embodiment has two insert feeders 401 and 402, which both feed an insert into and along an insert feed path. One or both inserts are then collated in the insert feeder collation section 450 and the collated inserts are held at insert staging area I whilst the sheets are folded. These collated inserts are then fed into the final fold in the sheet collation and form part of the folded document. Typically, these inserts might be booklets, business reply envelopes, compliment slips, product samples, etc. of varied shape, size, thickness and pliability.

Below the sheet feeders 1 to 4 is located the envelope feeder 600. This holds a plurality of envelopes in a stack, and has an associated mechanism for removing the single uppermost envelope from the stack and feeding said envelope along the envelope transport path 650. The envelope first undergoes a flapping process in flapper section 700, in which the flap is opened. The envelope is then held in the insertion region 750, where it is stopped. Mechanical fingers engage with and hold open the mouth of the envelope. In this state, the folded mail collation (including inserts) is inserted into the envelope by projecting the mail package towards the open mouth with sufficient velocity that its momentum will force it inside the envelope. This mail piece, comprising the folded mail package within the envelope, then proceeds to the sealing and ejection section 800. In the sealing and ejection section there is a moistening device 820 where the gum seal on the envelope flap is moistened. The envelope is then passed through a sealing/ejection mechanism 840. This performs a process which shuts and seals the moistened flap and ejects the envelope from the folder/inserter apparatus 1000 into a receiving tray or bin.

As noted above, the sled guide assembly SG, which includes sled 352 and traction belts 351 provides a guide on one side of the accumulation path. The traction belts are arranged to engage with the arriving sheets along at least a portion of the width W and the length L (FIG. 7) of the sled guide assembly. The sled guide assembly SG is biased towards the opposing fixed guide assembly OG including guide 353 and idlers 365 to 367, in order to maintain pressing engagement between the traction belts 351 and idlers 365 to 367. In fact, the force biasing the sled guide assembly to a closed position is very large compared with the desirable normal force between the belts 351 and sheets being accumulated. This is possible because the sled guide assembly is closed only to a predetermined gap, the gap being sufficiently small to prevent buckling of sheets in the accumulation chamber 364 but large enough to allow an accumulation to gather.

By appropriately selecting the size of this gap, and using a large biasing force, it can be assured that the sled guide assembly SG will resist a large buckling force to prevent the accumulated sheets from buckling, but that the traction belts 351 will remain in contact with sheets in the accumulator with an appropriately minimal normal force regardless of the thickness of the sheet accumulation. This is important to ensure that the driving force does not become excessive, thereby buckling or damaging the sheets.

Figure 9:
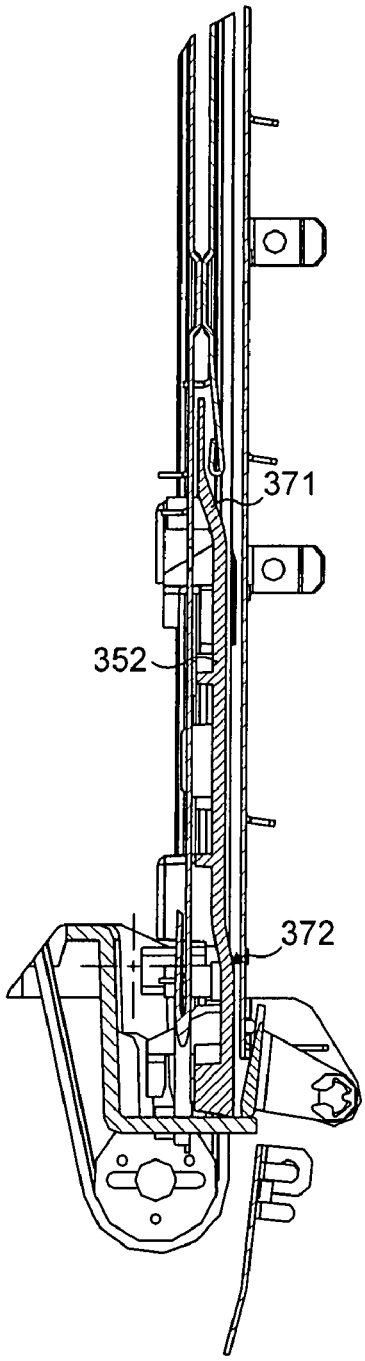
FIG. 9 is a cross-sectional view detailing the movable guide.

The sled 352 may also be stepped, as shown at 371 and 372 in FIGS. 7 and 9, in order to change the chamber thickness and thus the contact force at defined locations along the length of the accumulation chamber, preferably in conjunction with the suitable selected normal force provided by the fixed guide idlers 365 to 367. In the present embodiment, the chamber narrows to 1 mm width for the last 30 mm after the final belt idler set 367. This narrowed exit from the chamber continues to the gate 354 which is in direct or almost direct contact with the ends of the guide components 352, 353. Once the accumulation has been collated, the drive system can impose considerable vertical loading of the paper against the gate. Because of this driving force, if the gate now opens, the paper may try to push past before the gate is fully retracted, leading to damage as the lead edge is dragged and buckled over the tip of the gate. However, owing to the close proximity of the narrow exit of the chamber to the surface of the gate, and the arc along with the gate is opened, the paper is effectively swept off the face of the gate, preventing damage.

Figure 10:
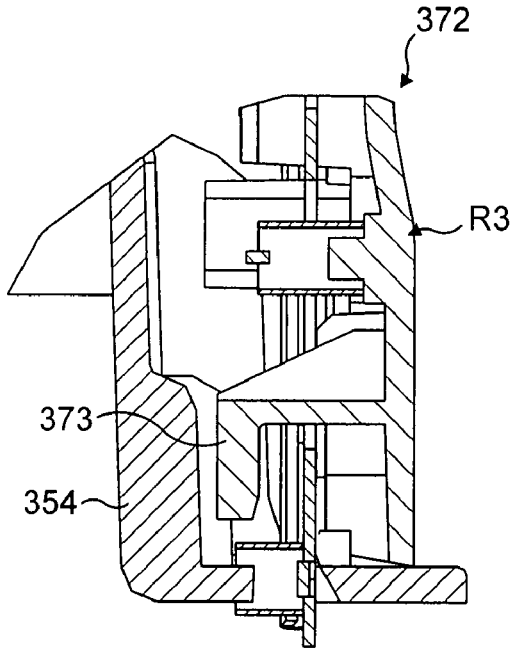
FIG. 10 is a cross-sectional view of the bottom of an accumulator comprising a movable guide.
Figure 11:
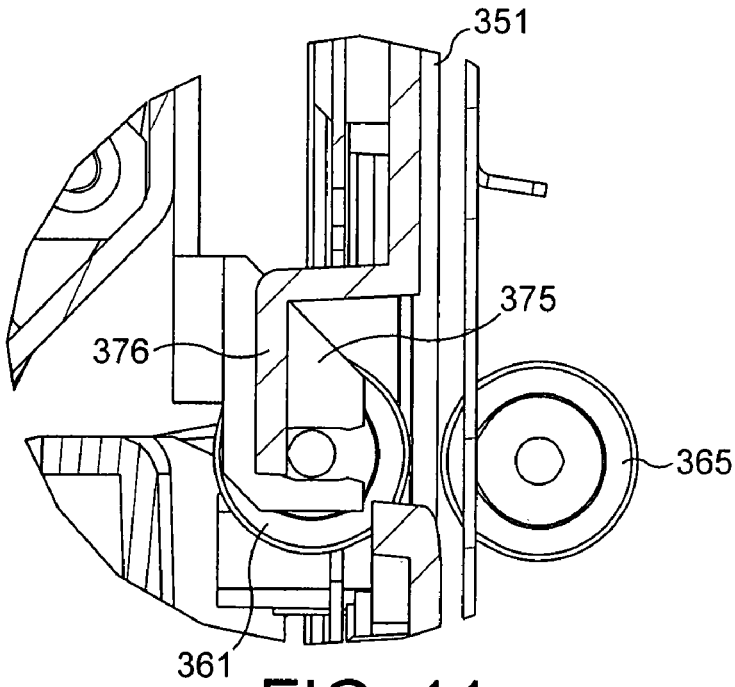
FIG. 11 is a cross-sectional view showing the movable guide in an accumulation position.
Figure 12:
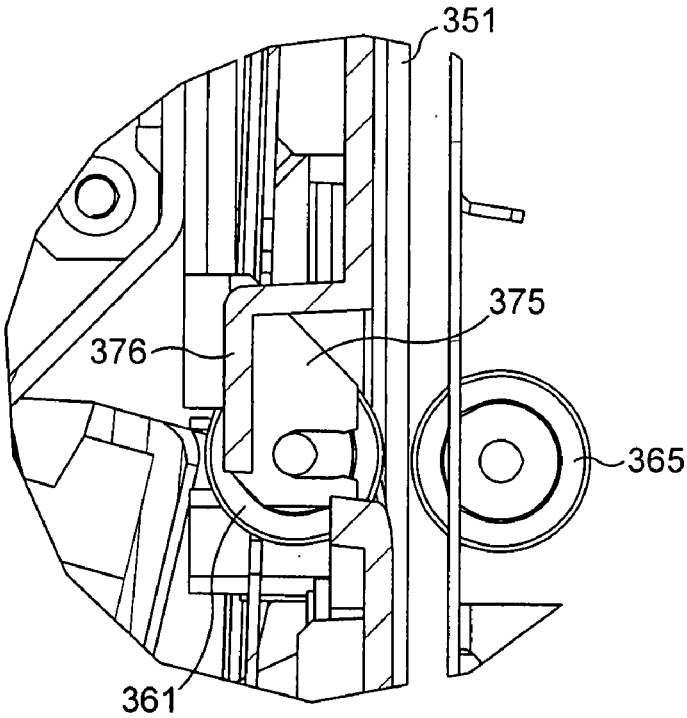
FIG. 12 is a cross-sectional view showing the movable guide in a retracted position.

The sled 352 is movable from a first accumulation position (FIG. 11) in which it is biased towards the fixed guide 353, and a second retracted position (FIG. 12) in which it is held away from the fixed guide 353 in order to create a clearance between the sled and any sheet material within the accumulation chamber. The movement of the sled in this manner between the accumulation position and the retracted position, is coordinated with actuation of the accumulation gate 354, such that when the accumulation gate is closed, the sled is in the accumulation position and biased against buckling forces which arise in the accumulated sheets. When the accumulation gate is actuated to release an accumulated collation, the sled is simultaneously retracted. According to the embodiment in FIG. 10, this may be achieved by hooks 373 attached to sled 352 which engage the gate 354 as it retracts, to thereby simultaneously retract the sled 352.

The accumulation chamber 364 (FIG. 5) has a 30 mm long narrowed exit and an inlet section of 80 mm length. The chamber thickness "t" is set by fixed guiding means 353 with idler rollers 361-364 which set the precise distance between the two surfaces. The sled 352 is mounted onto a frame, which supports its vertical position when the gate 354 is open, and mounts a set of springs which push the sled 352 towards the fixed guiding means 353. The frame interlocks with a set of hooks to pull the sled open when required. This actuating frame is, in turn, linked to the gate 354 and is biased towards the sled 352 by compression springs.

Consequently, when at rest, the gate 354 is closed and the sled 352 is pushed towards the fixed guiding means 353 with a force of several Newtons. Additionally the series of springs, slots and buffers/stops linking and biasing the sled guide assembly SG and gate 354 ensures that a wide tolerance range can be accommodated in the component parts without adversely affecting the critical parameters of the paper path gap.

The sequence of operation for releasing an accumulated collation involves opening the gate, which pulls the frame back, the sled remaining pushed towards the fixed paper path by springs (not shown) on the internal frame of the feeder/inserter. Once the gate has opened far enough to be swept clean by the stationary sled, the sled hooks pick up on the moving actuation frame and pull the sled clear of the fixed paper path, leaving a minimum gap of 3.5 mm.

In the present embodiment, the driving rollers 355 of the traction belts 351 form part of the sled construction and define a curved path around the top of the sled 352 and into the accumulation chamber 364. Along the length of each traction belt 351, there are located fixed idler rollers 361, 362 and 363 which provide rolling support for the traction belts along the length of the sled. If desired, these idlers may be biased towards the fixed guide 353 to vary the pressing force of the traction belts against sheets being accumulated along the length of the sled. To keep the traction belts taut, tension rollers 356 are located at the bottom of the sled, and also form part of the sled guide construction. However, the traction belts 351 and their supportive idler rollers 361, 362, 363 are not entirely fixed relative to the sled, but have a degree of freedom of movement relative to the guiding surface of the sled. Being able to retract the sled is particularly effective for allowing obstructive elements, such as staples or paper clips attached to the sheets, to pass through the accumulator 350. By linking the plate to the gate so that it retracts when the gate is opened, large packs with staples can pass through without suffering damage or restriction. This also means that when the sled is in the retracted position (FIG. 12), the driving means 351 may still be forced towards sheet material accumulated within the accumulation chamber, and can continue to provide a driving force to said sheet matter in order to propel the accumulated collation towards the next section of the folder/inserter apparatus 1000 even though the sled guide 352 has been retracted.

A maximum gap of 3 mm is available for the accumulation chamber 364, with the sled guide 352 in the accumulation position, before compromising paper column strength. A sophisticated design is, therefore, required to avoid the cumulative tolerances of the multiple components from becoming an issue. To achieve this, the idlers 361, 362, 363 are mounted in slots 375 in a sled 352 (FIGS. 11 and 12), the slots running substantially perpendicular to the plane of the paper path. Pockets in the sled encompass the idlers, and ledges 376 define the distance that the idlers protrude through the surface of the sled when the gate is closed (in the accumulation position). When the gate 354 opens and the sled 352 retracts, the idlers 361, 362, 363 travel to the end of the slots, which limit their travel to a position where they are still compressing the belt 351 against the matching sprung idlers 365, 366, 367 of the fixed guide.

The fixed guide 353, which works in conjunction with the movable sled, comprises a plurality of spring-loaded biased idler rollers 365, 366, 367 located opposite each of the idler rollers 361, 362, 363 of the sled, and serving to compress the traction belt 351 between the two sets of idler rollers. Thus, any sheet material entering the accumulation chamber 364 between the fixed guide 353 and the movable sled 352 will be forced into pressing engagement with the traction belt by the two sets of idler rollers.

The distance "t" (FIG. 5) between the movable sled 352 and the fixed guide 353 is determined according to the sheet material to be used, as well as the driving force to be applied by the traction belts 351. An important function of having the fixed guide 353 and the sled 352 to provide the accumulation chamber 364 is to prevent the sheets which are being accumulated from buckling under the driving force of the traction belts. Hence, the gap "t" between the two guiding means must be sufficiently small that the guides can support a sheet held there between whilst preventing the sheet from buckling. The material of the traction belt must also be appropriately chosen in order to ensure that, once the material is halted in the accumulation chamber, the traction belts will slip relative to the sheet material before the sheet material is caused to buckle.

By making the sled stand off from its opposite paper path by a very small amount, a gap is created. This allows, for example, paper to pass along accumulation chamber 364, reach the hard stop created by gate 354 and become accumulated without the paper being exposed to a high compressive normal force. A very large spring force can then be applied to the sled to resist being pushed off by a buckle starting to form in a sheet. This means that although the friction between belt 351 and the sheet is minimised, the paper is prevented from buckling excessively, therefore retaining the majority of its column strength.

Once the collation has been accumulated within the accumulator, forming a near-vertical stack, the accumulation gate 354 is opened to allow the accumulated collation to pass downwardly toward the sheet folding mechanism 500. As discussed above, the accumulated collation has a natural acceleration due to gravity of 1 g. In previous devices, acceleration of approximately 1 g was achieved for horizontal acceleration of the collation without shearing or shingling of the accumulated collations. With the vertical accumulator an acceleration of around 2 g can be utilised, by using gravitational as well as mechanical forcing, thus improving the volume-throughput of the machine.

As an alternative to an accumulation gate, it is possible to use a pair of pinch rollers which remain static during the accumulation process to halt the sheets, but are then rotated in order to assist the acceleration of the collation once accumulation has been completed.

Instead of a pair of traction belts 351, an alternative sheet-driving system may be employed within the accumulator, for example consisting of a single belt or of a plurality of belts, arranged either in parallel, in series, or as a combination of the two. It should also be noted that the use of belts is not necessary, and the sheets could be driven by a series of drive rollers or other such alternative means known to those skilled in the art. Similarly, it is not necessary for the belts or rollers to be aligned to drive precisely in the sheet-feeding direction through the accumulator, and they may, desirably in some cases, be aligned at an angle to the sheet-feed direction.

In the foregoing, there has been described a method of preventing single or multiple sheets of paper from reaching critical buckling and crumpling when compressed lengthways against a hard stop or gate 354 by traction belts 351. The paper buckle is restrained by the very close proximity of the two sides of the paper path. Making one side of the paper path as a sled 351 which can be retracted allows sheets with oversized features such as staples to pass. Opening the gate and retracting the sled in a coordinated movement, enables the lead edge of the sheets to be swept clearly off the gate surface, preventing damage of the sheets. The sled mechanism does not need to be linked directly to the gate, and an independent drive system or actuator could perform the same function of retracting the gate, but at increased cost and complexity of control.

The disclosed embodiment has a high robustness to tolerance, and enables the sled guide assembly SG to be mounted on a frame that opens, allowing an operator ease of access for clearing jams.

As described above, paper buckling is prevented by holding it nearly flat, without applying any direct pressure. This reduces the sheet to sheet friction that can prevent the individual sheets rotating relative to each other whilst being aligned to an end stop. Reducing this "resistance to deskew" allows a greater robustness to variation in the drive forces, deriving from production tolerances and wear related changes in friction, thus creating a machine which is ultimately lower cost, more reliable, runs for a longer life between services and can process a greater range of materials.

What is claimed is:

1. An accumulator apparatus for paper collations comprising:

an accumulation chamber for receiving sheet material, the chamber defined by a fixed guide on one side, a movable guide on an other side of the chamber and a movable stop member at one end in the chamber;

a plurality of rollers positioned over a length of the accumulation chamber for driving said sheet material against said stop member; and a mechanism that moves the movable guide between a first position in which the movable guide is spaced from the fixed guide by a gap sufficiently small to prevent buckling of the sheet material by a variable force distribution created by the rollers as the sheet material is driven by the rollers against the stop member, and a second position in which the movable guide is spaced away from the fixed guide for discharge of the sheet material from the chamber.

2. The accumulator apparatus according to claim 1, wherein the movable guide has a stepped guide surface such that in at least one region, when in the first position, the moveable guide define a section of sheet feed path having a reduced thickness.

3. The accumulator apparatus according to claim 2, wherein the reduced thickness is in the range from 1 mm to 3 mm.

4. The accumulator apparatus according to claim 1, wherein the rollers are located on the side of the guide of the sheet feed path and extends into the sheet feed path in order to engage sheet material as the sheet material travels along the sheet feed path, to thereby enable application of a driving force to the sheet material through frictional contact.

5. The accumulator apparatus according to claim 4, wherein the rollers means comprises a traction belt that runs substantially in the sheet feeding direction against a surface of the guide and occupies at least a portion of the length of the sheet feed path, and occupies at least a portion of the width of the sheet feed path.

6. The accumulator apparatus according to claim 5, wherein the rollers means comprises at least two traction belts running substantially in the sheet feeding direction.

7. The accumulator apparatus according to claim 5, wherein the rollers further comprises a plurality of spring rollers that are biased towards the tracking belt by different spring forces.

8. The accumulator apparatus according to claim 4, wherein the rollers comprises at least two traction belts running substantially in the sheet feeding direction.

9. The accumulator apparatus according to claim 4, wherein the movable guide further comprises first spring loaded idler rollers for forcing each traction belt into contact with sheet material as the sheet material passes along the sheet feed path.

10. The accumulator apparatus according to claim 1, wherein the fixed guide further comprises second spring loaded idler rollers for forcing sheet material in the sheet feed path into contact with the driving means.

11. The accumulator apparatus according to claim 10, wherein a pressing contact force between the rollers and sheet material in the sheet feed path, in a direction perpendicular to the sheet feed direction, varies along the length of the sheet feed path in the sheet feed direction.

12. The accumulator claimed in claim 1, wherein the mechanism is hooks.

13. The accumulator apparatus according to claim 1, wherein the mechanism is one or more hooks.

14. A sheet handling apparatus for paper collations comprising:

a guiding apparatus including:

an accumulation chamber for receiving sheet material, the chamber defined by a fixed guide on one side, a movable guide on an other side of the chamber and a movable stop member at one end of the chamber;

a plurality of rollers positioned over a length of the accumulation chamber for driving said sheet material against said stop member; and a mechanism that moves the movable guide between a first position in which the moveable guide is spaced from the fixed guide by a gap sufficiently small to prevent buckling of the sheet material by a variable force distribution created by the rollers as the sheet material is driven by the rollers against the stop member, and a second position in which the movable guide is spaced away from the fixed guide for discharge of the sheet material from the chamber.

15. A sheet handling apparatus according to claim 14, further comprising a stop at one end of the sheet feed path for selectively halting movement of sheets as they pass along the sheet feed path, thereby forming the accumulation chamber in an accumulation defined by the guides and the stop, the rollers driving successive sheets against the stop to accumulate the sheets, wherein the stop is controlled to halt sheets in the accumulation chamber until a package is accumulated and then to release the package once all sheets in the package have been accumulated together.

16. A sheet handling apparatus according to claim 15, wherein the movable guide is in the first position when the stop operates to halt the movement of sheets along the sheet feed path and moves to the second position when the stopping means releases the package.

17. The apparatus claimed in claim 14, wherein the rollers are spring rollers.

18. The apparatus claimed in claim 14, wherein the mechanism is one or more hooks.

19. A guiding method comprising:

driving sheet material into an accumulation chamber against a movable stop along a sheet feed path in a sheet feed direction between a fixed guide defining one side of said chamber and a movable guide defining an other side of said chamber; and selectively moving the movable guide between a first position in which the moveable guide is in close proximity to the fixed guide to prevent buckling of sheet material by a variable force distribution created by a driving device over a length of the accumulation chambers as the sheet material is driven against the stop and a second position in which the movable guide is spaced from the fixed guide for discharge of the sheet material from the chamber.

20. A method according to claim 19, wherein the movable guide has a stepped guide surface such that in at least one region, when in the first position, the guides define a section of sheet feed path having a reduced thickness.

21. A method according to claim 20, wherein the reduced thickness is in a range from 1 mm to 3 mm.

22. A method according to claim 19, wherein the driving device is located on the side of a surface of the guide of the sheet feed path and extending into the sheet feed path in order to engage sheet material as the sheet material travels along the sheet feed path to thereby apply a driving force to the sheet material through frictional contact.

23. A method according to claim 22, wherein the driving device comprises a traction belt that runs substantially in the sheet feeding direction supported by a surface of the guide surface, and occupies at least a portion of the length of the sheet feed path, and occupies at least a portion of the width of the sheet feed path.

* * * * *